United States Patent [19]

Flider

[11] 3,934,328

[45] Jan. 27, 1976

[54] PROCESS FOR MAKING A PLASTIC WALLED DEVICE

[75] Inventor: Frank S. Flider, Chicago, Ill.

[73] Assignee: Justrite Manufacturing Company, Chicago, Ill.

[22] Filed: Feb. 26, 1973

[21] Appl. No.: 335,516

Related U.S. Application Data

[62] Division of Ser. No. 98,557, Dec. 16, 1970, abandoned.

[52] U.S. Cl. ..... 29/453; 215/1 C; 222/469; 222/474; 264/94

[51] Int. Cl.[2] ..... B23P 11/02

[58] Field of Search ..... 29/453, 526; 215/1 C; 264/94; 222/469, 472, 474

[56] References Cited

UNITED STATES PATENTS

| | | | |
|---|---|---|---|
| 2,275,318 | 3/1942 | Rasmussen | 222/474 |
| 2,748,997 | 6/1956 | Richmond | 222/469 |
| 2,792,159 | 5/1957 | Richmond | 222/472 |
| 3,225,951 | 12/1965 | Poston et al. | 215/1 C X |
| 3,278,666 | 10/1966 | Donald | 264/94 X |
| 3,308,997 | 3/1967 | Kelly | 215/1 C UX |
| 3,469,747 | 9/1969 | Richmond | 222/469 |
| 3,770,160 | 11/1973 | Flider | 222/469 X |

FOREIGN PATENTS OR APPLICATIONS

| | | | |
|---|---|---|---|
| 1,416,663 | 9/1965 | France | 215/1 C |

*Primary Examiner*—Charlie T. Moon
*Attorney, Agent, or Firm*—Alter and Weiss

[57] ABSTRACT

A completely enclosed plastic can or container has a neck-like opening closed by a spring biased cap. The cap is controlled by a handle linkage connected to a vertical fin formed on the can by an enlargement of the flash line between two plastic mold parts, which are joined together to mold the container, preferably by a blow molding process. Springs automatically urge the cap and handle to a closed position when the container is sitting at rest. The cap opens as the can is tipped while the handle is being held. A clip-on pouring spout is snapped onto the neck to guide the fluid flowing from the can.

9 Claims, 5 Drawing Figures

PROCESS FOR MAKING A PLASTIC WALLED DEVICE

This is a division of application Ser. No. 98,557, filed Dec. 16, 1970, now abandoned.

This invention relates to new and improved plastic safety cans or containers, and especially — although not exclusively — to containers for inflammable fluids, and more particularly to low cost containers having pouring spouts removably attached thereto.

Containers for inflammables are not only known in the art, but also have very carefully prescribed safety regulations which are often enforced by governmental and industrial agencies. Thus, an improved container must have a better design than the other containers which are already on the market. Also, the improved container must meet or exceed these and other existing safety regulations. Finally, these containers must have a sales appeal, for the buying public, which goes beyond the sales appeal of previously available safety cans.

Previously, cans have generally been made of a heavy gauge steel material, such as 24-gauge Terne plate. Reinforcing ribs have been formed to add strength. Seams have been folded and crimped to provide four or five thicknesses of metal locked together by double seaming. Preferably, the container has been dipped in a hot lead or tin bath to provide a corrosion protection. Then, a fine quality of enamel was baked on over the tin coating.

These safety cans are often designed for storing an inflammable fluid, such as gasoline, and the cans often have flexible metal hoses permanently attached thereto for easy pouring without spilling. When fluid is about to be poured from the cans, the hoses are twisted or turned to fit into the container for receiving the fluid. However, there is a minimum radius beyond which the hose cannot be bent. Sometimes there are nearby obstacles so that the cans cannot be tipped, even when the hose bends at its minimum radius. Moreover, it usually is necessary to simultaneously bend the hose, insert it into an opening and pour the fluid. This is sometimes difficult to do.

To overcome these and other problems, some safety cans have sometimes been built with a rigid metal cup and hose combination hinge-mounted near its spout. Whenever the can is tipped, the fluid which it contains is poured into the cup and through a flexible metal hose depending from the bottom thereof. This way, the hose may be fitted into a container for receiving the fluid while the can is in a resting or a non-pouring position, and the can may be raised to a pouring position.

The metal can, cup, and hose assembly usually includes ferrous materials which may corrode and may create hazardous "sparks" responsive to an accidental contact with other ferrous materials. Also, the metal hose has a tendency to scratch the surfaces which they contact. Often these surfaces are plated steel, and the scratches remove the protective plating and expose the surfaces to corrosion. The present use of a flexible metal hose attached to a cup is not satisfactory since there is a tendency for the hose to break away from the cup under conditions of heavy use. Moreover, the metal safety can, cup, and hose are exposed parts which are frequently bumped whenever they are being transported or used. This bumping distorts the shape of the cup so that some times it cannot retain a liquid without spilling it. All of these disadvantages are overcome by the use of a non-conductive, non-metallic assembly incorporating the features of the invention.

Accordingly, an object of the invention is to provide new and improved plastic safety cans with cup and hose spout combinations. Here, an object is to provide clip-on cup and hose combinations which may be quickly and easily attached to or removed from a safety can. In this connection, an object is to provide a cup and hose combination which may be carried in automobiles for those occasions when an emergency filling becomes necessary and where other fuel containers are not available with any type of hose.

In keeping with an aspect of the invention, these and other objects are accomplished by a plastic safety can with a clip-on cup and hose combination. The can has a pouring neck which is automatically opened by holding a handle while tipping the can. The handle linkage is attached to a vertical fin formed on the can by bringing together a thickened flash formed on two mold halves used to make the can. The cup and hose combination has bellows, pleats, or folds which are molded from a flexible plastic material. This way, the bellows or folds help make a more flexible combination for both the cup and hose. The cup and hose has a metal clip adapted to clip on over the pouring neck, thus allowing for quick and easy attachment or removal.

The nature of a preferred embodiment of the invention for accomplishing these and other objects may be understood best from a study of the following description and the attached drawing in which.

Figure 1:
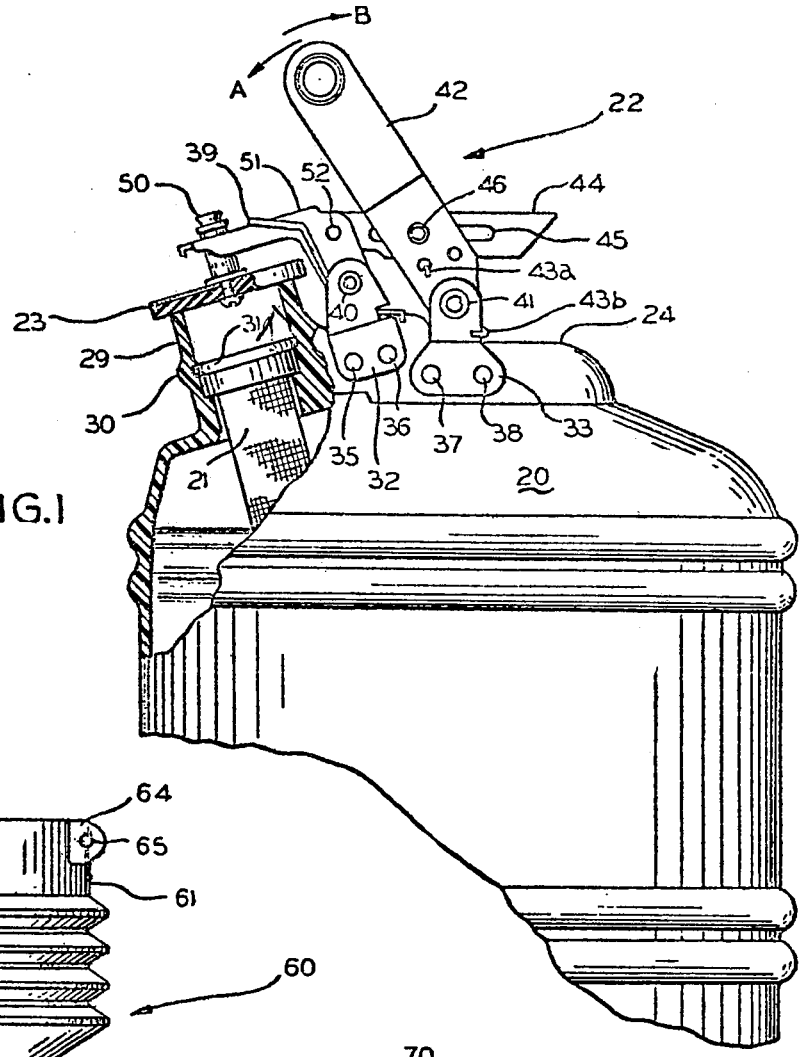
FIG. 1 is an elevation side view (partly in cross section) of a novel plastic safety can incorporating the invention.

The principal elements in FIG. 1 are an all plastic can 20, a filter screen arrangement 21, and a handle and linkage cap control arrangement 22. The handle and linkage automatically opens a normally closed cap 23 when the can is tipped and closes the cap when the can is at rest.

The can 20 is all plastic and formed by any suitable means— such as blow molding inside a mold cavity. The mold (not shown) includes two pieceparts which come together in a good fit. The flash line where the mold parts join, is thickened on the top to form an upstanding fin or rib 24 which is integral with and strengthens and supports the neck. The fin or rib is designed to have a strength adequate to support the handle and linkage mechanism 22 without distortion of the plastic. A series of holes 25–28 (FIG. 4) are molded into the plastic fin 24 in order to provide a means for attaching the handle and linkage 22.

Also formed in the plastic is an opening or vent 29 — shaped somewhat as the neck of a bottle — which enables fluid to be poured into or out of the container 20. The neck-like opening 29 is covered by the safety cap 23 which opens for filling or pouring. The filter screen 21 is suspended inside the neck-like opening 29 to strain the fluid entering and leaving the container. To facilitate such suspension, the neck is formed with an annular ring 30 for receiving a circular lock ring 31 having the filter screen 21 attached thereto. The outside of the annular ring 30 provides a location or arrangement for receiving and cooperating with a clip on the cup and hose combination.

The neck-like opening 29 includes a cylindrical part closed on the top by the safety cap 23, controlled by the handle and linkage 22, mounted on saddle brackets 32 and 33. These brackets are attached to the rib 24 by means of rivets 35–38 passing through the holes 25–28. The cap is spring loaded to a closed position by a spring 39 which wraps around a pin 40 in bracket 32 and bears down on top of the cap 23 with a predetermined pressure. Thus, when the vapor pressure inside the can exceeds, say 5 p.s.i., the bias of spring 39 is overcome, and the cap 23 raises to vent the can. As soon as the internal vapor pressure falls below 5 p.s.i., the spring 39 overcomes such pressure, and the cap 23 recloses.

The handle and linkage arrangement 22 are mounted on the bracket 33 attached to the top of the can 20, in approximately the center of gravity. Pivotally mounted on bracket 33, at the point 41, is a handle 42 having a spring 43*a*, 43*b* normally urging the handle 42 to swing in the direction A toward a low profile position when the container 20 is not in use. A horizontal linkage comprises a bar 44 having a longitudinal slot 45 in the bar 44. Thus if the handle 44 is raised, there is a lost motion as the pin 46 moves through the length of the slot 45 before any linkage action occurs. This amount of movement allows the user to secure a comfortable grip before lifting the weight of the can.

Attached to the cap 23 and forming part thereof is a pin or bracket 50 which is loosely connected to an L-shaped cover bracket assembly 51 pivotally connected to the saddle mounting 32 by the pin 40. The angle point of the L-shape is connected to the bar 44 by means of a pin 52. When the handle 42 moves in direction B, pin 46 encounters the end of slot 45 to pull bracket 51 with a sufficient force to open the cap 23, against the force of the spring 39.

It should now be apparent that when the handle 42 is lifted, it moves to an upright position without producing any effect upon the cap 23. When the bottom of the can 20 is thereafter lifted to a pouring position, pin 46 pulls back on the end of slot 45 to pull against pin 52 and rock the bracket 51 about the pivot point 40. The pin 50 is lifted by the end of bracket 51, and the cap 23 opens. When the can is set down, the reverse action takes place, and the cap 23 closes while the handle 42 moves forward to its low profile position.

Figure 2:
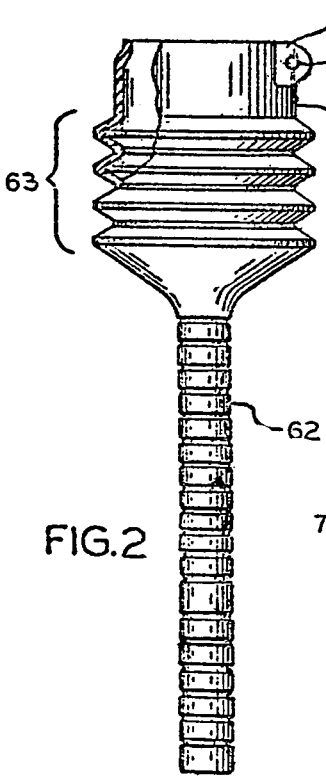
FIG. 2 is a side elevation view of a cup and hose combination for a clip-on attachment to the can of FIG. 1.

FIG. 2 shows the cup and hose combination 60 which comprises a cup part 61 and an integral hose part 62 which may be molded from any suitable material, such as a high density polyethylene. A low cost way of doing this is by the so-called "blow molding" technique. Since the entire unit is integral, there is no point of weak connection where the cup and hose join each other.

Figure 3:
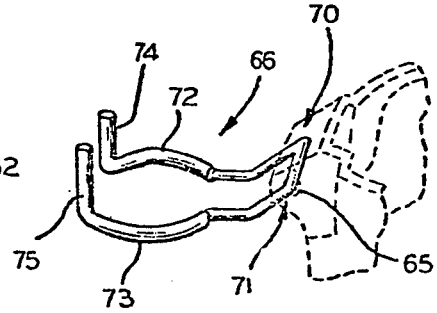
FIG. 3 is a perspective view of the clip used with the cup and hose combination, with a fragment of the cup shown in phantom.

The cup part 61 has a bellows-like arrangement 63 with a thickened hinge section 64, having a bore or hole 65 molded therein, to receive a wire clip 66 (FIG. 3). The bellows has a series of annular folds 63 which give added flexibility in the cup section itself. The lower surface of the cup 60 is somewhat funnel shaped, leading into the hose section 62.

The clip means 66 (FIG. 3) passes through the hole 65 in the cup section. The clip includes a wire spring having two right angle bends 70, 71 leading bifurcated arms of the clip away from the cup. The bifurcated arms are arcuately shaped at 72, 73 to embrace and hold the neck portion 29, preferably below the annular ring 30. Two upstanding ears 74, 75 terminate the arcuate sections 72, 73 to fit behind the neck 29. The parts 72–75 are preferably dipped in plastic to preclude any exposure of bare metal in parts making contact with the metal bracket and handle assembly 22 when the hose and cup are clipped onto the can. Thus, the hose combination may be quickly and easily clipped onto or removed from the neck of the can. Alternatively, the combination may be clipped onto any other convenient container having a similarly dimensioned neck.

Figure 4:
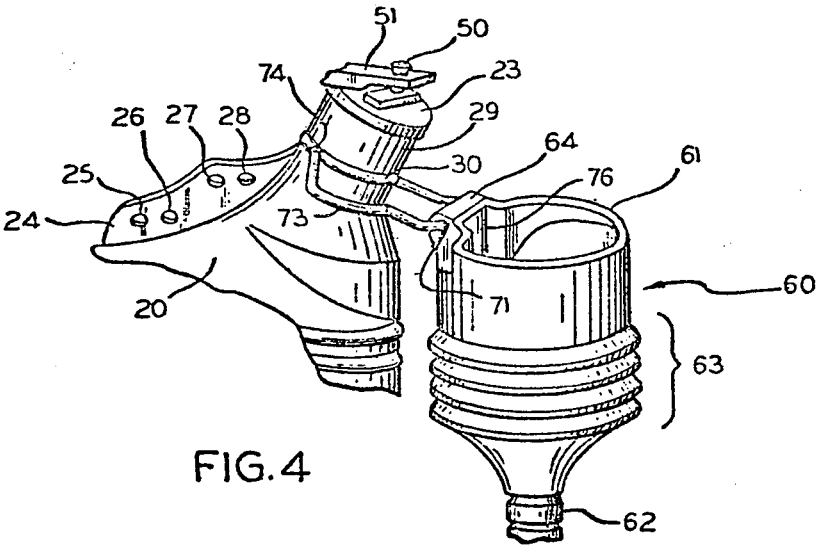
FIG. 4 is a perspective view of the safety can of FIG. 1 in a resting position, with the cup and hose of FIG. 2 clipped thereon.

As seen in FIG. 4, the peripheral contours of the cup 61 includes a porch shaped part 76 suspended beneath the projecting edge of the neck-like opening 29. Thus, if any fluid should fall from the lip of the neck, it drips into the part 76 and is guided by the lower funnel shape bottom of the cup 61 and into the hose 62.

Figure 5:
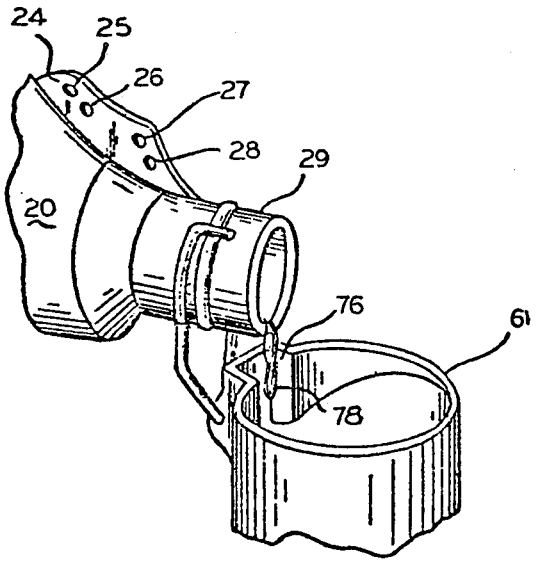
FIG. 5 is a perspective view of the combination of FIG. 4 tipped up to a pouring position.

The contours of the wire clip are shaped and proportioned so that any fluids dripping from the neck 29 always fall into the cup 61, as shown at 78 (FIG. 5) regardless of the angle at which the can is tipped.

The advantages of the invention should now be obvious from a reading of the foregoing specification. However, for completeness, it may be well to here note and recall that there is a solid external rim on the dome of the can. The fin or rib 24 provides the means for attaching the cap and cover control mechanism, the handle 42, etc. There is no need for attaching any components through the wall of the can itself. In addition, since the fin or rib 24 is integral with the neck-like opening or spout 29, it is reinforced and made rigid. Still other advantages will be apparent from a study of the specification, claims and drawing.

I claim:

1. A process for making a plastic walled device comprising:

a. forming a stock-shaped device having an outer surface and an inner surface separated by a wall of plastic, b. integrally forming on said outer surface a thickened two-sided fin portion projecting away from said outer surface.

c. placing a plate on each of the two sides of said fin, and d. passing a fastener through each of said plates and said fin without breaking through said inner surface.

2. The process of claim 1 wherein the device is molded inside a molding cavity formed by at least two mating mold parts which open and close along a parting line, said thickened fin being formed by cavity relief along said parting line where said two mating parts come together.

3. The process of claim 2 wherein said device has an upper outside surface and a lower outside surface, the device normally resting in a vertical position on the lower outside surface, whereby a vertical center of gravity line passes through said upper and lower surfaces when said device is resting in a normal position, said thickened fin being formed on the upper outside surface substantially juxtaposed over the intersection of the vertical center of gravity line and the outside surface.

4. The process of claim 3 and the added step of forming a second upstanding part projecting away from said outer surface, said second part and said fin being integrally formed to strengthen, stabilize, and support each other.

5. The process of claim 4 and the added step of shaping said second upstanding part in the form of a hollow cylinder with a concave annular groove formed inside said hollow cylinder to enable an optional part to be snap-fitted therein.

6. The process of claim 4 and the added step of providing optional accessories attached to said plates whereby different accessories may be attached to said fin to vary the utility of said stock device.

7. The process of claim 6 and the added step of snapping an optional accessory around said second upstanding part to vary the utility of said device.

8. The process of claim 4 and the added step of snapping an optional accessory around said second upstanding part to vary the utility of said device.

9. The process of claim 2 and the added step of blow molding said device inside said cavity.

* * * * *